US009157690B2

(12) United States Patent
Kreis et al.

(10) Patent No.: US 9,157,690 B2
(45) Date of Patent: Oct. 13, 2015

(54) DISTRIBUTION SYSTEM AND HEAT EXCHANGER APPARATUS

(75) Inventors: Helmut Kreis, Munich (DE); Wolfgang Sussmann, Munich (DE); Thomas Hecht, Puchheim (DE); Jorg Dietrich, Edling (DE); Michael Baus, Grafelfing (DE); Rudolf Wanke, Ottenhofen (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 770 days.

(21) Appl. No.: 13/338,728

(22) Filed: Dec. 28, 2011

(65) Prior Publication Data

US 2012/0175091 A1 Jul. 12, 2012

(30) Foreign Application Priority Data

Dec. 30, 2010 (DE) ..... 10 2010 064 405
Mar. 8, 2011 (DE) ..... 10 2011 013 340

(51) Int. Cl.
*F28F 9/02* (2006.01)
*F28D 3/04* (2006.01)

(52) U.S. Cl.
CPC . *F28F 9/026* (2013.01); *F28D 3/04* (2013.01); *F28F 9/0265* (2013.01); *Y10T 137/8593* (2015.04)

(58) Field of Classification Search
CPC ..... F28F 9/0265; F28F 9/0273
USPC ..... 165/157, 159, 160, 174
See application file for complete search history.

(56) References Cited

U.S. PATENT DOCUMENTS

| | | | | | |
|---|---|---|---|---|---|
| 1,567,814 | A | * | 12/1925 | Peebles | 165/158 |
| 2,050,158 | A | * | 8/1936 | Cacioppo | 165/159 |
| 2,830,797 | A | * | 4/1958 | Garland | 165/110 |
| 3,351,131 | A | * | 11/1967 | Berthold | 165/159 |
| 3,849,232 | A | | 11/1974 | Kessler | |
| 4,576,222 | A | * | 3/1986 | Granata et al. | 165/76 |
| 5,465,783 | A | * | 11/1995 | O'Connor | 165/134.1 |
| 5,651,270 | A | | 7/1997 | Low et al. | |
| 5,755,280 | A | * | 5/1998 | da Costa et al. | 165/140 |
| 6,089,313 | A | * | 7/2000 | Levy et al. | 165/140 |

(Continued)

FOREIGN PATENT DOCUMENTS

| | | | |
|---|---|---|---|
| CN | 1431453 | A | 7/2003 |
| CN | 201497418 | U | 6/2010 |

(Continued)

OTHER PUBLICATIONS

Search Report for EP2472211 dated Nov. 26, 2014.

*Primary Examiner* — Allen Flanigan
(74) *Attorney, Agent, or Firm* — Miller, White, Zelano, Branigan, P.C.

(57) ABSTRACT

The invention relates to a distribution system (1) for distributing a fluid (15) into a container (27) from a fluid inlet (26) of the container (27). Distribution system (1) comprises one or more guide plates that form a guide section (2) and a distribution section (3) that adjoins the guide section (2). Distribution section (3) has regions (4, 5) with openings (8, 9) for allowing fluid (17) to pass through. The invention also relates to a heat exchanger device (100) that has a container (27) with a fluid inlet (26), with at least one heat exchanger block (28) that is arranged in the container (27). A distribution system (101) according to the invention is arranged in the container (27) above the heat exchanger block (28).

8 Claims, 3 Drawing Sheets

(56) References Cited

U.S. PATENT DOCUMENTS

| | | | | |
|---|---|---|---|---|
| 6,167,713 | B1 * | 1/2001 | Hartfield et al. | 62/115 |
| 6,253,571 | B1 | 7/2001 | Fujii | |
| 6,505,472 | B1 * | 1/2003 | Cheng et al. | 62/93 |
| 6,868,695 | B1 * | 3/2005 | Dingel et al. | 62/515 |
| 7,147,048 | B2 * | 12/2006 | Mitsumoto et al. | 165/159 |
| 8,276,653 | B2 * | 10/2012 | Al-Anizi et al. | 165/159 |
| 8,365,812 | B2 * | 2/2013 | Al-Hadhrami | 165/159 |
| 2001/0017202 | A1 * | 8/2001 | Mitsumoto et al. | 165/174 |
| 2003/0111216 | A1 | 6/2003 | Hirao | |
| 2007/0028647 | A1 * | 2/2007 | Wang et al. | 62/506 |
| 2008/0163637 | A1 * | 7/2008 | Ring et al. | 62/304 |
| 2009/0242178 | A1 * | 10/2009 | Al-Anizi et al. | 165/134.1 |

FOREIGN PATENT DOCUMENTS

| | | | | |
|---|---|---|---|---|
| CN | 101806554 | A | 8/2010 | |
| CN | 101886891 | A | 11/2010 | |
| DE | 3315250 | A1 * | 10/1984 | F28F 9/22 |
| DE | 3347815 | A | 3/1985 | |
| DE | 39 13579 | A1 | 10/1990 | |
| DE | 10 2009 022 673 | A1 | 12/2010 | |
| FR | 2175757 | A1 | 10/1973 | |
| SU | 872936 | A | 10/1981 | |
| WO | 9841798 | A1 | 9/1998 | |
| WO | 2005055552 | A | 7/2005 | |

* cited by examiner

DISTRIBUTION SYSTEM AND HEAT EXCHANGER APPARATUS

SUMMARY OF THE INVENTION

This invention relates to a distribution system for distributing a fluid, particularly a fluid having a liquid portion and a gas portion. The invention also relates to a heat exchanger device with a corresponding distribution system.

Distribution systems are known, for example, as inlet distributors for introducing two-phase or multi-phase fluids into a container. In connection with gas-liquid separating containers, for example, so-called vane inlet devices are known for achieving equal distribution and improved pre-separation of the fluid. DE 10 2009 022 673 A1 discloses, for example, guide vanes arranged on a bottom plate in the form of lamellae with guards as a distribution system.

In particular in heat exchangers, it is desirable to distribute a refrigerant as homogeneously as possible in a jacket space. DE 39 13 579 A1 discloses, for example, a heat exchanger with pipes, running through a jacket space, through which a medium to be cooled flows. To achieve a uniform coolant distribution starting from an inlet nozzle in the surrounding flow space, a baffle plate is proposed. The disclosed baffle plate is provided with holes and arranged in a horizontal plane in the flow space.

It is desirable, for example, in the block-in-kettle structures of heat exchangers, to achieve a still better distribution of cooling fluid.

One object of this invention is to provide an improved distribution of fluid that flows into a container (e.g., kettle).

Upon further study of the specification and appended claims, other objects and advantages of the invention will become apparent.

Consequently, a distribution system for distributing a fluid into a container from a fluid inlet of the container is proposed. In this case, the distribution system comprises at least one guide plate, the guide plate comprising a guide section and a distribution section that adjoins the guide section. The distribution section has regions with openings for allowing fluid to pass through.

The distribution system can be closed in a fluid-tight manner laterally in such a way that fluid can travel downward only through the openings in the distribution section, otherwise the fluid is held within the distribution system.

The fluid can have, in particular, a liquid portion and a gas portion. For example, the fluid can be a refrigerant, which enters as a gas-liquid mixture into a jacket space as a container.

Since a corresponding fluid in general flows in only locally into the region of a fluid inlet or inlet nozzle of the container, an especially advantageous homogeneous fluid distribution is achieved by the distribution system, which can also be referred to as inlet flow diverter.

The distribution system is suitable, in particular, for use in a cryotechnical system. Uses, however, also comprise other process-engineering systems in which heat exchangers are used. This can be the case, for example, within the framework of the gas liquefaction or air separation.

In one embodiment of the distribution system, the guide plate is designed as a bent sheet with a profile. The profile in this case can be, for example, a circular section, a bent angle, or else an edge profile, for example in the form of an L-angle.

In one embodiment of the distribution system, the guide section and the distribution section are formed by at least two guide plates that are arranged on one another and are essentially perpendicular to one another. The guide plates can have, for example, a rectangular shape.

The distribution plate has openings, such as holes, gaps, slots, or, for example, recesses with other geometries, made by removal of material from the distribution plate, to allow in particular fluid to pass through in the downward direction. Preferably, the distribution system is arranged horizontally. The distribution section forms, for example, a horizontal surface with holes or slot openings.

In this respect, one embodiment of the distribution system for distributing a fluid into a container from a fluid inlet of the container comprises at least two guide plates arranged on one another and essentially perpendicular to one another. In this case, one of the guide plates that functions as the distribution section has regions with openings for allowing fluid to pass through. For example, a first guide plate, functioning as the guide section, can be designed, in particular, as a baffle plate, and a second guide plate can be designed as a distribution sheet. The guide plate that is designed as a baffle plate preferably runs vertically, and the guide plate embodied as a distribution sheet runs horizontally.

The distribution system is preferably completely or partially closed laterally and vertically so that a fluid flow is directed essentially through the openings of the distribution sheet.

The guide plates can be designed as an angled sheet that is made of one piece of material.

In one design of the distribution system, the two guide plates form an L-profile, and side plates are arranged on the front sides of the L-profile. The side plates laterally seal off, for example, the distribution system, in a fluid-tight manner. By an angled design, in particular with side plates, it is possible, in one container, to limit a section of space that, for example, acts like a distribution channel.

Preferably, the openings are designed as slots. The slots are designed in particular in the distribution sheet and in the direction that is essentially perpendicular to one edge of the distribution sheet or a profile angle.

The distribution system is preferably formed at least partially from aluminum or high-grade steel. The material selection can be matched to the respective use of the distribution system, for example, use in a cryogenic system.

A further aspect of the invention is a heat exchanger device comprising a container (kettle) having at least one fluid inlet, at least one heat exchanger block arranged within the container, and a distribution system according to the invention arranged within the container above the heat exchanger block.

The heat exchanger device is designed in particular as a block-in-container heat exchanger. It is also called a core-in-shell or block-in-kettle heat exchanger arrangement. See, for example, the core-in-shell heat exchanger disclosed in U.S. Pat. No. 5,651,270. Here, in general, several heat exchanger blocks, designed in most cases as plate heat exchangers, are arranged beside one another within a container or in a jacket space. The jacket space forms, for example, a flow space for the cooling medium, which in most cases is evaporated isothermally, thereby cooling fluid flowing through the heat exchanger blocks by indirect heat exchange. The heat exchanger blocks are preferably arranged on the same level. A non-isothermal evaporation can also be carried out.

In this respect, an embodiment of the heat exchanger device according to the invention comprises a container having a fluid inlet, several heat exchanger blocks arranged within the container, and, above the heat exchanger blocks, a distribution system for distributing fluid that flows in through the fluid inlet, whereby, in accordance with the invention, the distribution system comprises at least one guide plate having a guide section and a distribution section that adjoins the guide section, and whereby the distribution section has regions with openings to allow the fluid to pass through.

In one embodiment, the container is designed cylindrical and forms a jacket space defining a flow region for the refrigerant. The cylinder shaft in this case is preferably arranged horizontally.

In a preferred embodiment, the distribution system is made from a baffle plate, which runs vertically, and a distribution sheet, which runs horizontally along or parallel to the cylinder's longitudinal axis. The openings that are directed downward into the distribution sheet lie above the heat exchanger blocks or the block. Here, above is defined as being higher in a vertical direction. The distribution system does not necessarily have to run completely above the heat exchanger blocks.

Preferably, in the heat exchanger device, the distribution system is arranged in the container in such a way that a fluid that flows in by the fluid inlet into the container flows through the openings of the distribution section in specified jacket regions. For example, inflowing fluid can fall, at least partially, on the heat exchanger block. The arrangement and embodiment of the openings allows a specific distribution of the liquid portion of the fluid through the openings into or beside the heat exchanger block(s) in the jacket space.

Preferably, using the distribution system, fluid, in particular liquid, is introduced or distributed in regions of the jacket space where as little gas as possible or no gas is produced within the jacket space by evaporation of the cooling fluid, for example, by a heat exchanger block. The separation of a gas and liquid phase is thus improved.

In one embodiment of the heat exchanger device, the distribution system together with walls of the container and the optional side plates limits a section of space in the container. The distribution system and walls of the container enclose, for example, a section of space. The section of space, for example in the form of a distribution channel, connects the fluid inlet in one wall of the container to the flow space or jacket space using openings in the distribution section of the distribution system.

For example, the section of space on the inflow side is coupled to the fluid inlet, and the section of space on the outflow side is coupled to the openings in the distribution section as an outlet.

In one embodiment of the heat exchanger device, the fluid inlet has an inlet cross-sectional surface and an inlet direction. The distribution system preferably has a longitudinal axis that is embodied horizontally and parallel along the lengthwise extension of the container.

Preferably, the lengthwise extension of the distribution system is perpendicular to the inlet direction. In one embodiment, the openings in the distribution section are designed as slots that are perpendicular to a lengthwise axis of the container. The slots run, for example, parallel to the cross-sectional surfaces of the section of space or the container, which are formed perpendicular to a longitudinal axis of the container.

In a preferred embodiment of the heat exchanger device, the cross-section of a distribution channel, that is formed using the distribution system and walls of the container, corresponds to an inlet cross-section of the fluid inlet. As a result, an especially advantageous mass flow division can be achieved, for example, from the fluid inlet to the left and right away from a corresponding nipple.

In a preferred embodiment, the distribution system is designed in the form of an L-profile sheet. Preferably, the width of the individual slots that form the openings in the distribution section is between 30 mm and 70 mm. Especially preferably, the slots are 50 mm wide.

In one embodiment of the heat exchanger device, the openings are designed as slots, and the slots are positioned a distance of between 40 mm and 100 mm from one edge or from one angle of the L-profile sheet. Especially preferably, the distance is between 60 mm and 80 mm.

In still another embodiment of the heat exchanger device, the entire cross-sectional surface area of all openings in the distribution section corresponds to between 150% and 250% of the cross-sectional surface area of the fluid inlet. Especially preferably, the total cross-sectional surface area of the openings is twice as large as the cross-sectional surface area of the inlet. The distribution system is then preferably laterally sealed off by the side plates. In principle in this case, several inlet nozzles are also conceivable.

In still another embodiment of the heat exchanger device, the distribution section of the distribution system is designed with fluid impermeable regions in such a way that there is no heat exchanger block under a fluid impermeable region.

For example, the distribution section of the distribution system is provided with openings that exclusively direct fluid towards the heat exchanger block(s) and is otherwise designed to be fluid-tight. As a result, no fluid drips or flows into regions between heat exchanger blocks positioned beside one another in the container.

In particular, the heat exchanger blocks and the distribution system are arranged in the heat exchanger device in such a way that the openings of the distribution section are present above the heat exchanger blocks, and the distribution section is otherwise closed.

As an alternative, the distribution section of the distribution system is provided with openings that exclusively direct fluid towards regions exclusively beside or between the heat exchanger blocks, and is otherwise designed to be fluid-tight. As a result, no fluid drips or flows into regions above the heat exchanger blocks in the container.

In particular, in the heat exchanger device, the heat exchanger blocks and the distribution system are arranged in such a way that openings of the distribution section are present in regions beside the heat exchanger blocks or to the side of them, and the distribution section is otherwise closed.

In a further development of the heat exchanger device, one or more fluid outlets are provided in addition to a fluid inlet. Below the fluid outlets of the container, in particular for gaseous fluid, there are no openings of the distribution section of the distribution system.

In the proposed heat exchanger device, the fluid is distributed as a cooling medium from above the heat exchanger blocks via a horizontal distribution channel of the distribution system to provide advantageous circulation of the cooling medium to the heat exchanger blocks. By the arrangement of openings, the fluid can be directed specifically into regions of the flow region where the heat exchanger blocks are located in such a manner that a gas-liquid separation is performed efficiently possible.

Additional possible implementations or variants to the distribution system or the heat exchanger device also comprise combinations, not explicitly mentioned, of features described previously or subsequently relative to the embodiments. In this case, one skilled in the art will also add individual aspects as improvements or additions to the respective basic shape of the distribution system or the heat exchanger device.

BRIEF DESCRIPTION OF THE DRAWINGS

Additional configurations of the invention are subjects of the subclaims as well as of the embodiments of the invention that are described below. The invention is illustrated schematically with reference to an exemplary embodiment in the drawing and will be described extensively hereinafter with reference to the drawing. Various other features and attendant advantages of the present invention will be more fully appreciated as the same becomes better understood when considered in conjunction with the accompanying drawing wherein:

FIG. 1 shows a perspective diagrammatic representation of a first embodiment of a distribution system according to the invention. The distribution system 1 in this case comprises a vertical guide sheet 2 and a horizontal guide sheet 3, which form an L-angle along a common edge 13. The vertical guide sheet 2 is used as a guide section, and the horizontal distribution sheet 3 is used as a distribution section. For example, in the orientation of FIG. 1, fluid enters from the right and flows to the left in the direction normal to the surface of the guide sheet 2. The distribution sheet 3 has regions 4, 5 with openings 8, 9. Between the regions 4, 5 with the openings 8, 9, there is a fluid impermeable region 10. Fluid can pass downward through the openings, which in FIG. 1 are configured as slots 8 in the rear region 4 and as holes 9 in the front region 5.

Figure 1:
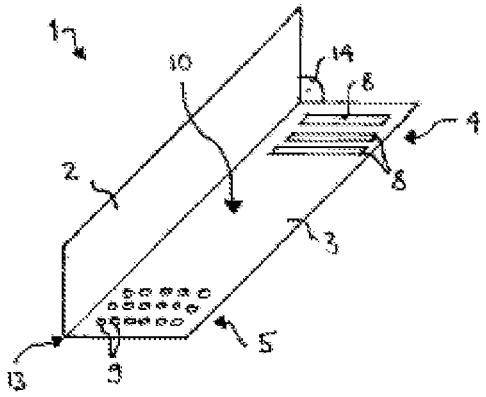
FIG. 1 shows a diagrammatic representation of a first embodiment of a distribution system.

The distribution system 1, as shown in FIG. 1, combines the functions of a perforated baffle plate with that of an inlet flow diverter, i.e., a distributor near an inflow inlet of a container. The guide section 2 serves essentially to discharge or to divert fluid. Using openings 8, 9, the distribution section 3 makes it possible to release fluid directly below the distribution system 1.

Figure 2:
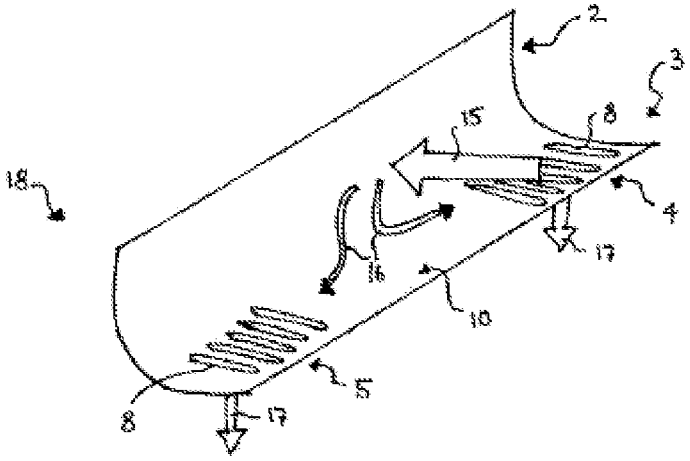
FIG. 2 shows a diagrammatic representation of a second embodiment of a distribution system.

FIG. 2 shows a perspective diagrammatic representation of a second embodiment of a distribution system according to the invention. The distribution system 18 is designed in the form of a bent guide sheet. In this case, FIG. 2 shows a guide section 2 that is vertical in the orientation of FIG. 2 and a horizontal distribution section 3 of the guide sheet. In the distribution section 3, there are regions 4, 5 with longitudinal openings 8 in the form of slots. In the middle region 10 of the distribution section 3, there are no holes or slots, i.e., region 10 is fluid impermeable.

In FIG. 2, a possible fluid flow is indicated by arrows. For example, fluid 15 that flows in through an inlet nozzle of a container reaches the guide sheet of the distribution system 18. By the guide section 2, the fluid is essentially diverted horizontally to the left and right, as the arrows 16 indicate. Under the action of gravity, the fluid flows or streams along the fluidtight region 10 in the direction of the regions 4, 5 that are provided with openings 8. There, the fluid exits downward through the openings 8, which is indicated by arrow 17.

Figure 3:
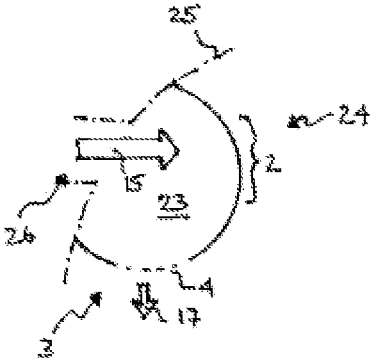
FIG. 3 shows a diagrammatic representation of a third embodiment of a distribution system.

FIG. 3 shows a diagrammatic cross-sectional representation of a third embodiment of a distribution system according to the invention. The distribution system 24 that is depicted in FIG. 3 is fabricated as a circular-section-shaped profile, for example from a sheet such as aluminum or high-grade steel.

As in the embodiments depicted in FIGS. 1 and 2, the shape of the distribution system 24, together with a container wall 25, forms a distribution channel. As is depicted in profile in FIG. 3, the bent guide sheet ensures a fluidtight seal with a container wall 25, which is depicted here as being round. The space region 23 can be viewed as a horizontal distribution channel.

A guide section 2 is provided opposite a container opening or fluid inlet 26. Fluid 15 flowing in through the fluid inlet 26 strikes the distribution section 2 of the distribution system 24. In the lower region, openings directed downward are provided in the sheet of the distribution system 24, which are depicted in dots. The circular section, which essentially points downward, is referred to as a distribution section 3. The fluid 17 can exit downward through the areas of the sheet that are provided with openings in the regions 4.

A specific supply of fluid, for example in the direction towards the heat exchanger blocks, can be carried out by the arrangement and positioning of openings within the distributor channel 23. Above and below are defined here as relative to gravitational acceleration, which is generally depicted vertically. In this connection, horizontal means perpendicular to the gravitational acceleration.

Figure 4:
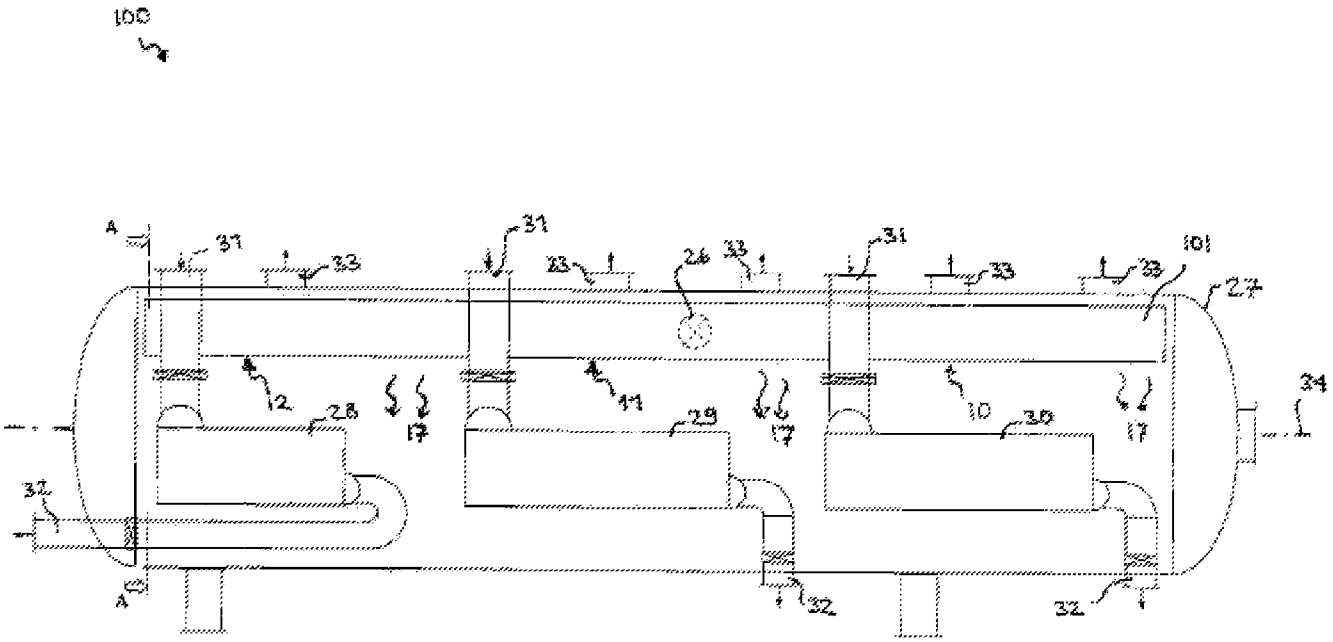
FIG. 4 shows a longitudinal sectional representation of an embodiment of a heat exchanger device.
Figure 5:
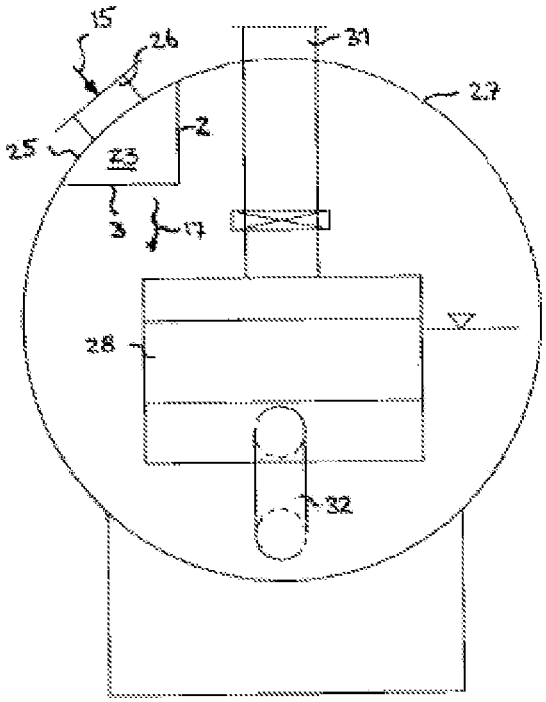
FIG. 5 shows a cross-sectional representation of an embodiment of a heat exchanger device.
Figure 6:
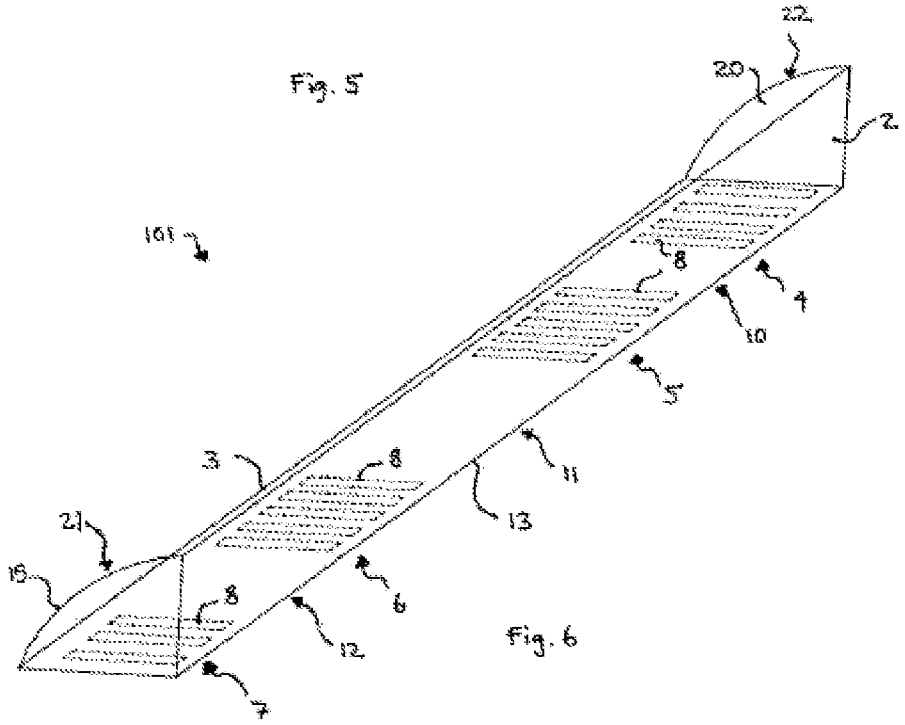
FIG. 6 shows a diagrammatic representation of a fourth embodiment of a distribution system.

Below, an embodiment of a heat exchanger device is explained in more detail based on FIGS. 4 to 6. In this case, in FIG. 4 depicts a heat exchanger device 100 in longitudinal section. FIG. 5 depicts a section A-A that is crosswise to an axis of symmetry of the heat exchanger device 100. In FIG. 6, a representation of a fourth embodiment of a distribution system 101 is presented in perspective, which is provided in the heat exchanger device 100.

The heat exchanger device 100 is designed as a block-in-container configuration. This means that several heat exchanger blocks 28, 29, 30 are incorporated within a cylindrical container 27, which is also referred to as a jacket. One advantage of this block-in-container arrangement, also referred to as core-in-shell or block-in-kettle, in particular, is that heat exchanger blocks in the form of plate heat exchangers can be used especially efficiently. In the case of plate heat exchangers, multiple layers of heat-exchange passages are delimited from one another by separating sheets, which in general leads to a parallelepiped-shaped block.

As seen in FIG. 4, three heat exchanger blocks 28, 29, 30 are provided within a cylindrical container 27, whose longitudinal axis 34, which also is an axis of symmetry, runs horizontally. For example, fluid that is to be liquefied, such as natural gas or a process gas, is cooled within the heat exchanger blocks 28, 29, 30, by being fed into the heat exchanger blocks 28, 29, 30 through inlet nozzles 31, which flow through the jacket or container 27 into an upper region, and by being discharged as a cooled fluid via outlet nozzles 32, which are provided in the lower region of the jacket 27.

In the internal space of the jacket 27, which can also be referred to as a flow space, in most cases a primarily liquid refrigerant is isothermally evaporated. In this respect, a fluid inlet 26 is provided in the jacket 27 in approximately the center in the upper region. The fluid is referred to below as refrigerant or refrigerating medium. The refrigerant in this case enters locally as a gas-liquid mixture. The liquid portion is evaporated on the heat exchanger blocks 28, 29, 30 and exits from the jacket space again as gas through fluid outlet openings 33. The fluid inlet 26 is in this case arranged lower than the fluid outlets 33 for the refrigerating medium. It is desirable that only the gas portion of the refrigerating medium be removed from the jacket space via the outlet nozzles or fluid outlets 33. To reduce as much as possible an entrainment of liquid refrigerating medium, an improved distribution of the gas-liquid mixture that enters through the fluid inlet nozzles 26 is desired. A distribution system 101 is therefore provided in the container 27.

In particular in the cross-sectional representation of FIG. 5, the circular cross-section of the cylinder jacket 27 is viewed as a container and the heat exchanger block 28 that is provided in the interior space is viewed with an intake 31 and a discharge 32 for fluid to be cooled. In the orientation of FIG. 5, the fluid inlet 26 is provided in the circular segment lying on the upper left. The refrigerating medium 15 introduced via the fluid inlet 26 enters a distribution channel 23. The distribution channel 23 is formed by a section of space within the jacket 27, which is formed by the jacket wall 25 and a guide sheet, designed L-shaped, that has a guide section 2 and a distribution section 3.

FIG. 6 shows a perspective representation of an embodiment of the distribution system 101. FIG. 6 shows the distribution system 101 with a guide sheet 2, which is provided vertically, and a distribution sheet 3, which is provided horizontally. Also, side sheets 19, 20 are provided, which are mounted on the L-profile edges and are connected in a fluidtight manner to the guide and distribution plates 2, 3. One edge or contour 21, 22 of the side sheets 19, 20 nestles against the container wall 25 (cf. FIG. 5) and forms a fluidtight closure with the container or jacket wall 25.

The section of space or distribution channel 23 produced by this arrangement connects the fluid inlet 26 to the interior space of the jacket 27 via the openings 8 in the distribution plate 3. The openings 8 are provided in the form of slots and run essentially perpendicular to a lengthwise extension of the distribution system 101 and perpendicular to an axis of symmetry 34 of the container 27.

In combination with FIGS. 4, 5, and 6, it is seen that fluid impermeable regions 10, 11, 12 are provided in the distribution plate 3. On the one hand, no heat exchanger block 28, 29, 30 is present below regions 10, 11, 12 of the distribution plate 3, and, on the other hand, inlet or outlet nozzles 26, 33 are arranged above regions 10, 11, 12 of the distribution plate 3. The regions 4, 5, 6, 7 with openings 8 are essentially positioned above, but between, the heat exchanger blocks 28, 29, 30. Thus, it is ensured that a gas-liquid separation of the refrigerating medium takes place simultaneously over the entire length of the container, and liquid refrigerating medium does not flow directly onto the heat exchanger blocks 17 (arrow 17).

It is also recognized that the fluid inlet of the container (e.g., inlet 26) is arranged essentially at the middle of the lengthwise extension of the distribution system 101. As a result, an incoming fluid is split into two partial flows, corresponding in each case to approximately half of flow of incoming fluid. For example, the inlet nozzle 26 has a specified inlet cross-section. In a circular inlet nozzle, the cross-section $A=\pi/4\times d^2$, whereby d is the diameter of the inlet nozzle 26. Preferably, the sum of all cross-sections $A_i$ of the openings 8 is twice as large as the cross-section A of the fluid inlet: $\Sigma_i A_i=2\times A$. This means that the number and geometry of the slot 8 is selected based on the cross-section of the inlet nozzle 26.

Studies of the applicant have shown that the slots 8 should have a minimum distance from an edge 13, i.e., the inside angle of the L-profile. As noted above, the slots are preferably positioned a distance of between 40 mm and 100 mm from the angle of the L-profile sheet, especially preferably, the between 60 mm and 80 mm.

The geometry and the dimensions of the distribution channel 23 through an L-profile are selected in such a way that as uniform a distribution of the cooling medium as possible is achieved into the jacket space. The number of slots per lengthwise section of the distribution plate 3 or slot cross-sections can be reduced, for example, in regions where a gas concentration of the fluid is especially high, by evaporation of the cooling medium on the heat exchanger blocks 28, 29, 30. As a result, the gas portion can be managed at the openings by vapor that is introduced at the refrigerating medium inlet.

By the incorporation of the flow channel using a distribution system, as it was explained based on embodiments, an efficient distribution of the gas and liquid phase portion of the cooling medium can be achieved. By the integration of the distribution system within a container with use of the container wall, the weight and the expense when implementing a corresponding distribution channel are kept especially low.

Although this invention was explained based on embodiments, it is not limited thereto but rather can be modified. The proposed materials for the sheet and depicted geometries are defined only by way of example. Also, practical examples other than those explicitly mentioned are conceivable for distribution or heat exchanger devices.

The entire disclosure[s] of all applications, patents and publications, cited herein and of corresponding German Application Nos. DE 10 2010 064405.6, filed Dec. 30, 2010, and DE 10 2011 013340.2, filed Mar. 8, 2011 are incorporated by reference herein.

The preceding examples can be repeated with similar success by substituting the generically or specifically described reactants and/or operating conditions of this invention for those used in the preceding examples.

REFERENCE NUMBERS USED

1 Distribution system
2 Guide section
3 Distribution section
4-7 Regions with openings
8 Slot
9 Hole
10-12 Closed regions
13 Corner
14 Angle
15-17 Fluid flow
18 Distribution system
19, 20 Side sheet
21-22 Side sheet edge
23 Distributor channel
24 Distribution system
25 Container wall
26 Fluid inlet
27 Jacket
28-30 Heat exchanger block
31 Inlet
32 Outlet
33 Fluid outlet
34 Jacket Axis
100 Heat exchanger device
101 Distribution system

The invention claimed is:

1. A heat exchanger device (100) comprising:

a container (27), having a fluid inlet (26), at least one plate heat exchanger block (28) arranged within said container (27), and a distribution system (101) that is arranged above said at least one plate heat exchanger block (28) in said container (27) for distributing a fluid (15) into said container (27) from said fluid inlet (26) of said container (27), wherein said distribution system (101) comprises a guide section (2) and a distribution section (3) that adjoins the guide section (2), wherein said distribution section (3) comprises regions (4, 5) having openings (8, 9) to allow fluid (17) to pass through, wherein said guide section (2) and said distribution section (3) are formed from at least two guide plates that are arranged on one another and are essentially perpendicular to one another, wherein one of said guide plates functions as said distribution section (3) and is a horizontal distribution plate which has said regions (4,5) with said openings (8, 9) to allow fluid (17) to pass through, and the other of said guide plates functions as said guide section (2) and is a baffle plate, wherein said container (27) has a cylindrical shape and is arranged horizontally, wherein said baffle plate (2) runs vertically along or parallel to the longitudinal axis of the cylindrically shaped container (27), and said distribution plate (3) runs horizontally along or parallel to the longitudinal axis of the cylindrically shaped container (27), and wherein said distribution system (101) and a wall of said container (27) delimit a space (23) within said container (27), and said space (23) is in fluid communication with said fluid inlet (26) and is in fluid communication with said openings (8,9) in said distribution plate (3).

2. The heat exchanger device according to claim 1, wherein said distribution system further comprises side plates (19, 20).

3. The heat exchanger device according to claim 1, wherein said openings (8) of said distribution section (3) are designed as slots having a longitudinal direction that is essentially perpendicular to an edge of said distribution section (3).

4. The heat exchanger device according to claim 1, wherein said distribution system (101) is made at least partially from aluminum or high-grade steel.

5. The heat exchanger device according to claim 1, wherein said distribution system (101) is arranged within said container (27) in such a way that a fluid (15) flowing through said fluid inlet (26) into said container (27) would fall through said openings (8) of said distribution section (3) and at least partially onto said at least one plate heat exchanger block (28).

6. The heat exchanger device according to claim 1, wherein said distribution section (3) comprises fluid impermeable regions (10, 11, 12) positioned in such a way that said at least one plate heat exchanger block (28) is arranged at least partially under said fluid impermeable regions (10, 11, 12).

7. The heat exchanger device according to claim 1, wherein the combined cross-sectional surface area of said openings (8) of said distribution section (3) corresponds to between 150% and 250% of the cross-sectional surface area of said fluid inlet (26).

8. The heat exchanger device according to claim 1, wherein said guide section (2) is arranged opposite said fluid inlet (26).

* * * * *